US010294741B2

(12) United States Patent
Lewis et al.

(10) Patent No.: US 10,294,741 B2
(45) Date of Patent: May 21, 2019

(54) MITIGATING SWAB AND SURGE PISTON EFFECTS IN WELLBORES

(71) Applicant: Halliburton Energy Services, Inc., Houston, TX (US)

(72) Inventors: Derrick W. Lewis, Conroe, TX (US); James R. Lovorn, Tomball, TX (US); Jon T. Gosney, Bellville, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 594 days.

(21) Appl. No.: 14/646,930

(22) PCT Filed: Dec. 28, 2012

(86) PCT No.: PCT/US2012/072102
§ 371 (c)(1),
(2) Date: May 22, 2015

(87) PCT Pub. No.: WO2014/105054
PCT Pub. Date: Jul. 3, 2014

(65) Prior Publication Data

US 2015/0308203 A1 Oct. 29, 2015

(51) Int. Cl.
*E21B 21/08* (2006.01)
*E21B 47/06* (2012.01)
(Continued)

(52) U.S. Cl.
CPC ..... *E21B 21/08* (2013.01); *E21B 10/60* (2013.01); *E21B 21/103* (2013.01);
(Continued)

(58) Field of Classification Search
CPC ..... E21B 10/60; E21B 21/08; E21B 21/103; E21B 34/101
See application file for complete search history.

(56) References Cited

U.S. PATENT DOCUMENTS 2,946,565 A * 7/1960 Williams ..... E21B 17/18 166/106
4,002,063 A 1/1977 Angehrn
(Continued)

FOREIGN PATENT DOCUMENTS

| | | | |
|---|---|---|---|
| CN | 102226377 | A | 10/2011 |
| DE | 3541826 | A1 | 6/1987 |
| WO | 0214649 | A1 | 1/2002 |

OTHER PUBLICATIONS

International Search Report and Written Opinion dated Sep. 24, 2013 for PCT Application PCT/US2012/072102 filed on Dec. 28, 2012. (16 pages).

(Continued)

*Primary Examiner* — Caroline N Butcher
(74) *Attorney, Agent, or Firm* — Chamberlain Hrdlicka

(57) ABSTRACT

A method of mitigating undesired pressure variations in a wellbore due to movement of a well tool string in a well can include selectively decreasing and increasing fluid communication between sections of a wellbore on opposite sides of at least one well tool in the well tool string, the fluid communication being increased in response to detecting a threshold movement of the well tool string relative to the wellbore. A well tool string can include a well tool connected in the well tool string, and having an enlarged outer dimension relative to adjacent sections of the well tool string, a flow passage extending between the well tool's opposite ends, a sensor, and at least one flow control device which selectively permits and prevents fluid communication between the opposite ends via the flow passage, in response to an output of the sensor indicative of movement of the well tool string.

10 Claims, 9 Drawing Sheets

(51) Int. Cl.

| | |
|---|---|
| ***E21B 47/01*** | (2012.01) |
| ***E21B 47/12*** | (2012.01) |
| ***E21B 10/60*** | (2006.01) |
| ***E21B 21/10*** | (2006.01) |
| ***E21B 34/10*** | (2006.01) |

(52) U.S. Cl.
CPC ..... *E21B 34/101* (2013.01); *E21B 47/011* (2013.01); *E21B 47/06* (2013.01); *E21B 47/12* (2013.01); *E21B 47/124* (2013.01)

(56) References Cited

U.S. PATENT DOCUMENTS

| | | | | |
|---|---|---|---|---|
| 5,297,634 | A | 3/1994 | Loughlin | |
| 6,289,998 | B1 * | 9/2001 | Krueger | E21B 7/18 175/107 |
| 7,096,975 | B2 * | 8/2006 | Aronstam | B63B 21/502 175/232 |
| 7,114,579 | B2 | 10/2006 | Hutchinson | |
| 2008/0164062 | A1 * | 7/2008 | Brackin | E21B 21/103 175/24 |
| 2009/0041597 | A1 | 1/2009 | Brunner | |
| 2009/0095528 | A1 * | 4/2009 | Hay | E21B 4/02 175/26 |
| 2011/0232917 | A1 | 9/2011 | Skinner et al. | |
| 2012/0175108 | A1 | 7/2012 | Foubister et al. | |
| 2015/0354280 | A1 * | 12/2015 | Downton | E21B 4/02 175/107 |

OTHER PUBLICATIONS

Extended EP Search Report issued in corresponding application No. 12890954.6 dated Jun. 28, 2016, 6 pgs.

* cited by examiner

MITIGATING SWAB AND SURGE PISTON EFFECTS IN WELLBORES

TECHNICAL FIELD

This disclosure relates generally to equipment utilized and operations performed in conjunction with a subterranean well and, in one example described below, more particularly provides for mitigating swab and surge piston effects in wellbores.

BACKGROUND

Swab and surge effects can be caused when a tubular string (such as a drill string, casing string or completion string) is displaced in a wellbore. Such swab and surge effects can produce undesired pressure variations in the wellbore, possibly leading to fluid loss from the wellbore, influxes into the wellbore from a surrounding formation, fracturing of a formation, breakdown of a casing shoe, or other undesired consequences.

Therefore, it will be appreciated that improvements are continually needed in the art of mitigating swab and surge effects in wellbores.

DETAILED DESCRIPTION

Figure 1:
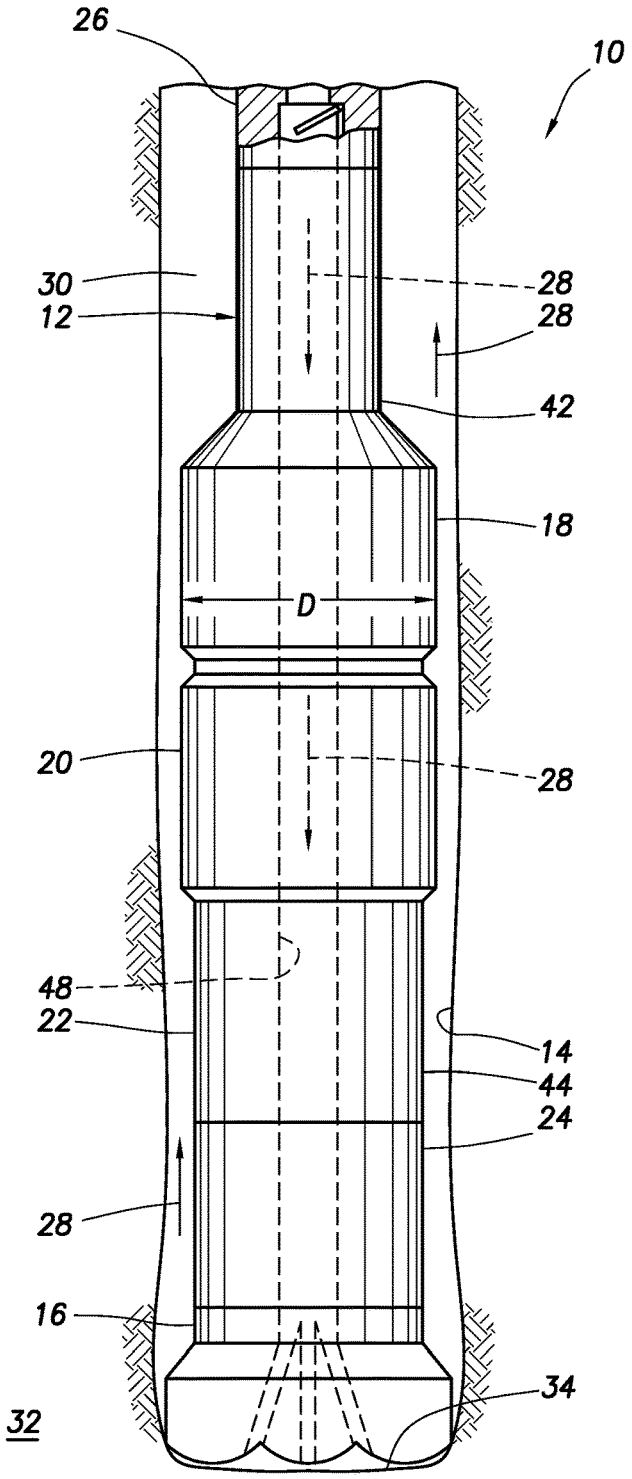
FIG. 1 is a representative partially cross-sectional view of a well system which can embody principles of this disclosure.

FIG. 1 is a representative partially cross-sectional view of a well system 10 which embodies apparatus principles of the disclosure and can be used to practice various method principles of this disclosure. However, it should be clearly understood that the well system 10 is merely one example embodiment as that, in practice, a wide variety of other examples are possible. Therefore, the scope of this disclosure is not limited at all to the details of the well system 10 and associated method(s) described herein and/or depicted in the drawings.

In the FIG. 1 example, a well tool string 12 is used to drill a wellbore 14. The well tool string 12 comprises a drill string, including a drill bit 16, one or more drill collars 18, a measurement-while-drilling (MWD) sensor and telemetry tool 20, a drilling motor 22 (such as, a positive displacement or Moineau-type motor, a turbine), a steering tool 24, and other drill string components. The drill bit 16, drill collars

18, MWD tool 20, drilling motor 22, steering tool 24, and other components may be collectively referred to as a bottom hole assembly (BHA).

A non-return valve 26 may be provided to allow flow of a drilling fluid 28 in only one direction through the drill string toward the drill bit 16. The drilling fluid 28 returns to surface via an annulus 30 formed radially between the string 12 and the wellbore 14.

Although the FIG. 1 example includes certain well tools and a particular arrangement of those well tools, it should be clearly understood that the scope of this disclosure is not limited to only the depicted well tools and/or combination or arrangement of well tools. Instead, the principles of this disclosure are applicable to many different examples in which mitigation of swab and/or surge effects is desired.

Figure 2:
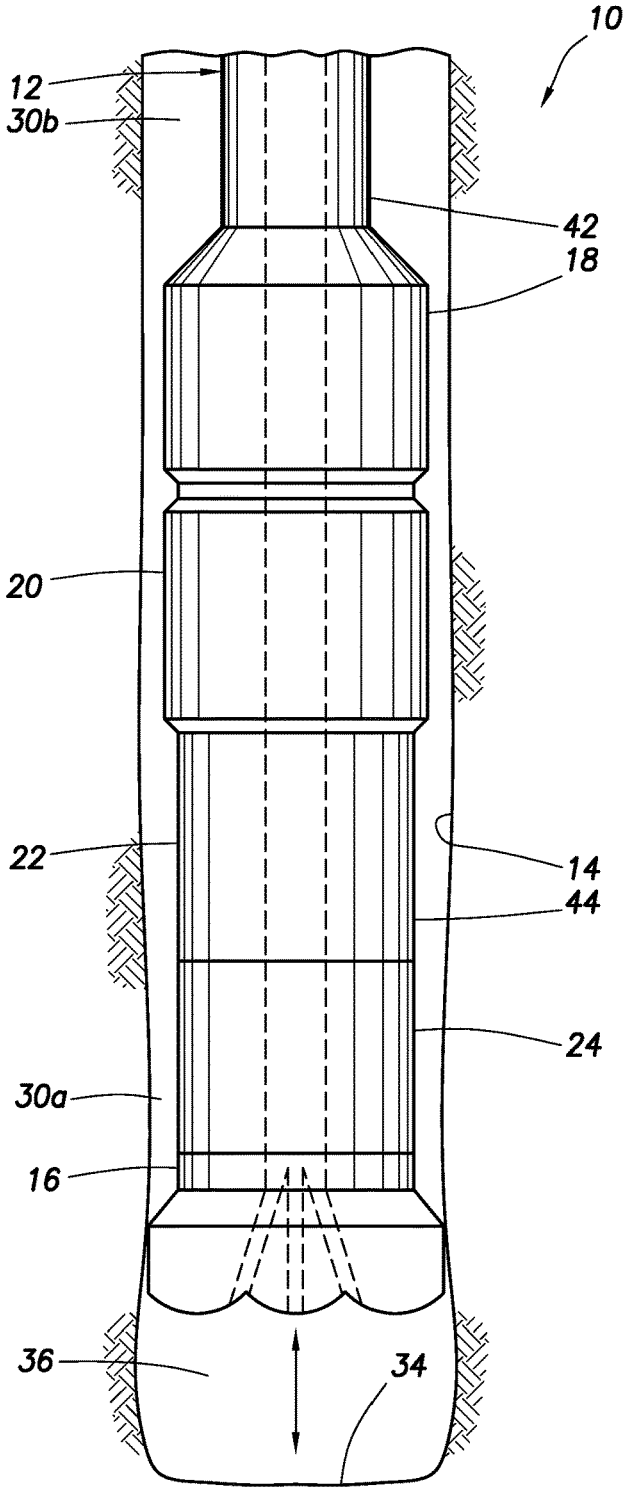
FIG. 2 is a representative partially cross-sectional view of the system of FIG. 1, with a well tool string being displaced in a wellbore.

With the drill bit 16 in contact with a bottom 34 of the wellbore 14, only relatively slow displacement of the string 12 downward (as viewed in FIG. 1) is permitted as the drill bit 16 cuts into a formation 32 penetrated by the wellbore. FIG. 2 is a representative partially cross-sectional view of the system 10 of FIG. 1, with a well tool string being displaced in a wellbore. If the well tool string 12 is displaced rapidly upward or downward relative to the wellbore 14, as representatively depicted in FIG. 2, portions of the string having enlarged outer dimensions (e.g., larger outer diameters) will displace fluid in the wellbore 14 and cause swab and/or surge effects therein.

Such displacement of the string 12 can be the result of heave motion on a floating rig (not shown), tripping into or out of the wellbore 14, and other displacements of the string. In the FIG. 2 example, swab and surge effects in a bottom section 36 of the wellbore 14 are exacerbated as a distance between the BHA and the bottom 34 of the wellbore decreases.

Specifically, if the string 12 displaces downward (as viewed in FIG. 2) toward the bottom 34 of the wellbore 14, pressure in the bottom section 36 of the wellbore will increase, and pressure in a section 30*b* of the annulus 30 above the BHA will decrease, resulting in a pressure differential across the BHA. Conversely, if the string 12 displaces upward (as viewed in FIG. 2) away from the bottom 34 of the wellbore 14, pressure in the section 30*b* of the annulus 30 above the BHA will increase, and pressure in the section 36 of the wellbore will decrease, again resulting in a pressure differential across the BHA, but in an opposite direction. Pressure in a section 30*a* of the annulus 30 surrounding the BHA may increase or decrease as the string 12 displaces in each direction, depending on restrictions to flow in the annulus about the various well tools in the BHA.

It is desired, in the FIGS. 1 & 2 example, to mitigate potentially harmful pressure increases and/or decreases in the wellbore 14 by eliminating or at least reducing the pressure differentials across well tools (such as the BHA of FIGS. 1 & 2) which result from displacement of the string 12 in the wellbore. However, it should be appreciated that the bottom section 36 of the wellbore 14 is only one wellbore section which can experience pressure increases and/or decreases due to movement of the string 12, and the scope of this disclosure is not limited to mitigating undesired pressure variations in the wellbore below the drill bit 16. For example, pressure in the section 30*b* of the annulus 30 above the BHA can increase or decrease due to movement of the string 12.

Figure 3:
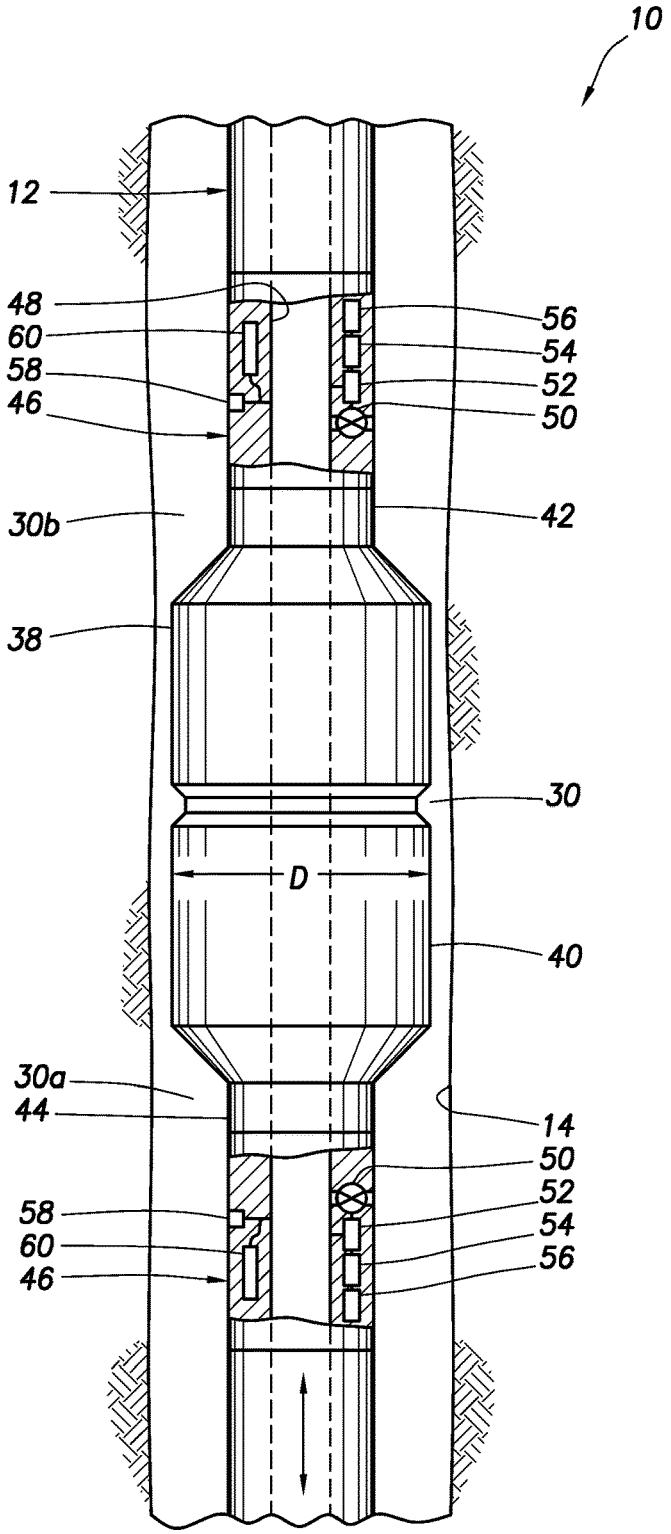
FIG. 3 is a representative partially cross-sectional view of another example of a well system.

FIG. 3 is a representative partially cross-sectional view of another example of a well system, in which the string 12 includes well tools 38, 40 connected in the string. The well tools 38, 40 have larger outer diameters, as compared to adjacent sections 42, 44, and so the enlarged outer diameters of the well tools act as an annular "piston" in the wellbore 14, with restricted flow in the annulus 30 about the well tools. Thus, a pressure differential can be created in the wellbore 14 (e.g., between the annulus sections 30*a,b*) by displacing the string 12 relative to the wellbore.

The well tools 38, 40 could be any type of well tools, for example, the drill bit 16, drill collars 18, MWD tool 20, drilling motor 22, steering tool 24, non-return valve 26, or any type of drilling, completion or cementing tool. The scope of this disclosure is not limited to use of any particular number, type or combination of well tools.

In the FIG. 3 well system 10, pressure balancing tools 46 are connected in the string 12 on opposite sides of the well tools 38, 40. The tools 46 provide selective fluid communication between each of the annulus 30*a,b* sections and a flow passage 48 extending longitudinally through the string 12. In this manner, pressure differentials between the annulus sections 30*a,b* due to displacement of the string 12 can be prevented or at least reduced.

Each of the tools 46 includes a flow control device 50 (e.g., a valve or choke) which opens and closes to respectively permit and prevent fluid communication between the flow passage 48 and the annulus 30 on an exterior of the string 12. Actuation of the device 50 is controlled by a processor 52, with memory 54 and a power supply 56 (such as batteries, a downhole generator, electrical conductors or fiber optics).

One or more sensors 58 detects one or more parameters indicative of movement of the string 12 relative to the wellbore 14. For example, pressure sensors 58 of the tools 46 can detect pressure in the annulus sections 30*a,b* and, thus, a pressure differential between the annulus sections which is due to movement of the string 12. Of course, a single pressure differential sensor could be used instead of separate sensors to detect pressures in separate sections of the wellbore 14.

An accelerometer can directly measure acceleration of the string 12, and an integrator can be used to determine velocity of the string from the measured acceleration (velocity equals acceleration integrated over time). A gyroscope or rotation sensor may be used to measure rotational speed and/or acceleration (for example, to determine whether the string 12 is rotating). Thus, the scope of this disclosure is not limited to use of any particular type of sensor(s) used to measure a parameter indicative of the movement of the string 12 in the wellbore 14.

When the sensors 58, or either of them, detect substantial movement of the string 12 sufficient to produce an undesired pressure increase and/or decrease in the wellbore 14, the flow control devices 50 can open, thereby providing fluid communication between the annulus sections 30*a,b* via the flow passage 48, and reducing or eliminating a pressure differential between the annulus sections. Opening of the flow control devices 50 can be synchronized by use of telemetry devices 60 (such as, devices capable of short hop acoustic or electromagnetic telemetry, or other types of wired or wireless telemetry).

In this manner, the opening and closing of the flow control devices 50 can be substantially simultaneous. If desired, actuation of a first flow control device 50 could be delayed, in order to allow for wireless transmission time and decoding to actuate a second flow control device 50, so that the flow control devices are actuated substantially simultaneously. If wired communication is used, simultaneous actuation may be achieved without the delay. Use of the telemetry devices 60 can also allow the number of sensors 58 to be reduced (e.g., a single accelerometer could be used to control actuation of multiple flow control devices 50).

In other examples, the flow control devices 50 may not be actuated synchronously. Thus, the scope of this disclosure is not limited to synchronous (or substantially synchronous) actuation of the flow control devices 50.

Note that it is not necessary for the sensors 58 to be contained in either or both of the tools 46. For example, if the MWD tool 20 includes an accelerometer and/or pressure sensor, those sensor(s) may be used in place of the sensors 58. The tools 46 may communicate with the MWD tool 20 via wired or wireless telemetry (e.g., short hop acoustic or electromagnetic telemetry).

Since MWD tools generally include a variety of sensors, those sensors can possibly be of use in controlling actuation of the pressure balancing tools 46 in other ways. For example, the MWD tool 20 can include a weight-on-bit and/or torque sensor 58 which measures compression and/or torque in the string 12.

The flow control devices 50 can be maintained closed when the weight-on-bit or torque sensor 58 measures compression or torque in the string 12 indicative of a bit-on-bottom condition or drilling ahead (in which case movement of the string 12 relative to the wellbore 14 should be insufficient to produce harmful pressure variations). In this manner, for example, accelerations measured by the sensor 58 during drilling (which accelerations may be quite large, but of relatively short duration, so that they do not cause excessive pressure variations in the wellbore 14) will not cause the flow control devices 50 to open.

The processor 52 may be programmed to maintain the flow control devices 50 closed if compression and/or torque in the string 12 is above a predetermined threshold. The processor 52 may be programmed to only open the flow control devices 50 if acceleration, velocity or other displacement of the string 12 is above a predetermined value or duration threshold. However, the scope of this disclosure is not limited to any particular manner of controlling actuation of the flow control devices 50.

Although the pressure balancing tools 46 are depicted in FIG. 3 as being separate tools connected in the string 12, the components of the tools could instead be incorporated into the well tools 38, 40. Similarly, the components of the pressure balancing tools 46 could be incorporated into any of the well tools (e.g., drill bit 16, drill collars 18, MWD tool 20, drilling motor 22, steering tool 24, non-return valve 26) in the FIGS. 1 & 2 example, as well.

Although the pressure balancing tools 46 are depicted in FIG. 3 as including certain components (e.g., flow control device 50, processor 52, memory 54, power supply 56, sensors 58, telemetry device 60), it is not necessary for a pressure balancing tool to include any particular number, arrangement or combination of components. If multiple pressure balancing tools 46 are used, it is not necessary for each tool to include the same components. The scope of this disclosure is not limited to use of any particular pressure balancing tool 46 configuration(s).

Figure 4:
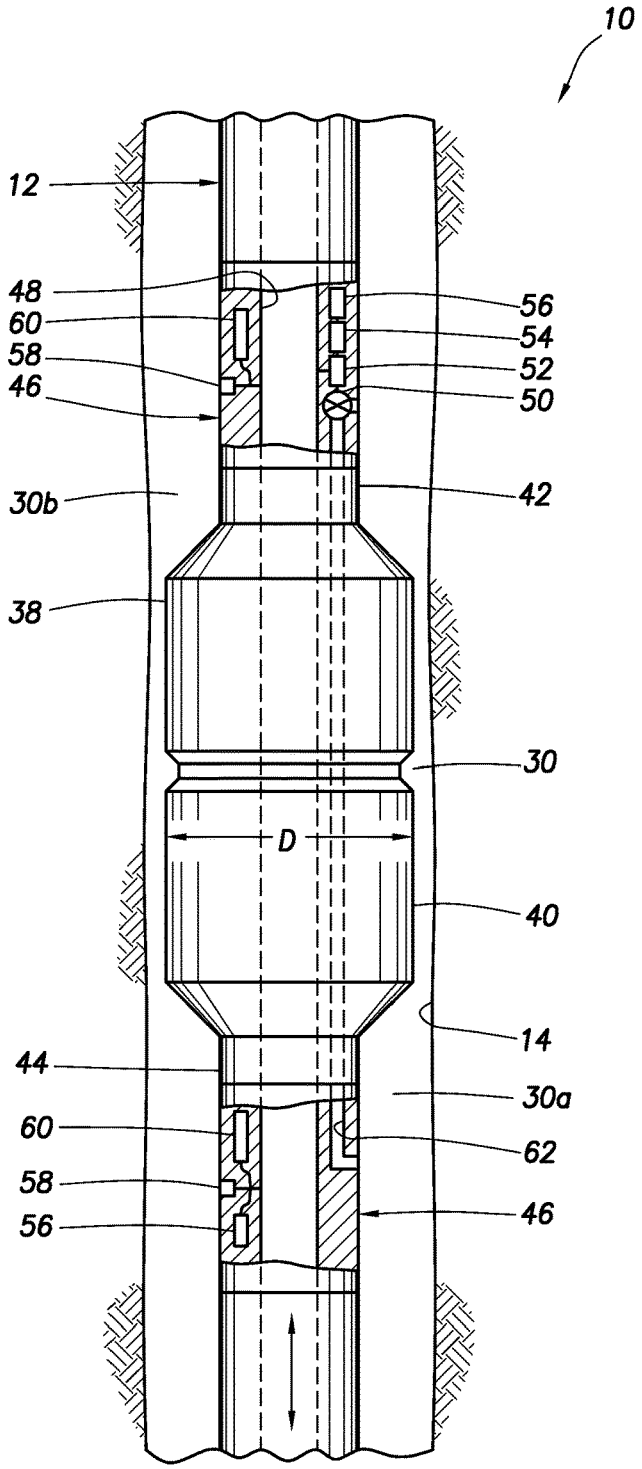
FIG. 4 is a representative partially cross-sectional view of yet another example of a well system.

FIG. 4 is a representative partially cross-sectional view of yet another example of a well system, in which the pressure balancing tools 46 are connected in the string 12 on opposite sides of the well tools 38, 40. However, in this example, the tools 46 are not configured the same, and the flow passage 48 is not used for providing fluid communication between the annulus sections 30*a,b*.

A separate flow passage 62 extends longitudinally in the well tools 38, 40 for providing fluid communication between the annulus sections 30*a,b*. A single flow control device 50 in the upper pressure balancing tool 46 is used to control flow through the passage 62, in order to reduce or eliminate any pressure differentials between the annulus sections 30*a,b*.

The lower pressure balancing tool 46 does not include a flow control device, processor or memory in this example. Only the sensors 58, power supply 56 and telemetry device 60 are included in the lower tool 46. However, various configurations of the upper and lower tools 46 may be used, in keeping with the scope of this disclosure.

When the sensors 58 (or only one sensor, or any combination of sensors) detects that sufficient movement of the string 12 is occurring to cause undesired pressure increases and/or decreases in the wellbore 14, the flow control device 50 can be opened to prevent or relieve any pressure differential across the well tools 38, 40 by allowing flow between sections of the wellbore on opposite sides of the well tools 38, 40.

Note that, in the FIGS. 3 & 4 examples, two well tools 38, 40 have enlarged outer dimensions D in the string 12. However, in other examples, only one well tool, or any combination of well tools (e.g., the BHA of the FIGS. 1 & 2 example) may have pressure differentials created across them, due to movement of the string 12.

Figure 5:
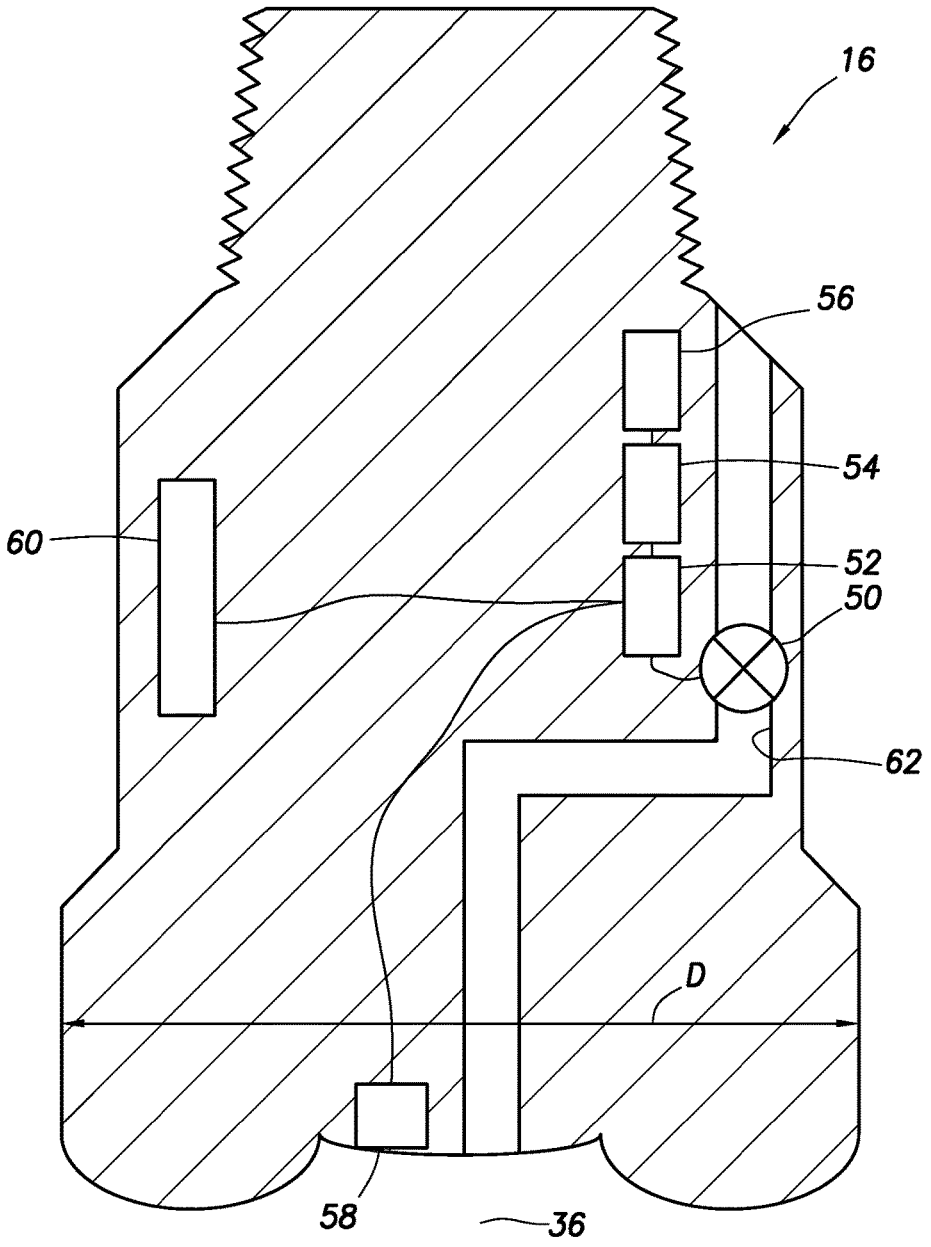
FIG. 5 is a representative cross-sectional view of a drill bit which can embody the principles of this disclosure.

FIG. 5 is a representative cross-sectional view of a drill bit 16, which can have a pressure balancing device incorporated therein. In this example, the well tool is the drill bit 16 of the FIGS. 1 & 2 example, but other well tools (such as the drill collars 18, MWD tool 20, drilling motor 22, steering tool 24, non-return valve 26, well tool 38, well tool 40, drilling tools, cementing tools, and completion tools) can have the pressure balancing device incorporated therein, in keeping with the scope of this disclosure.

In the FIG. 5 example, the drill bit 16 has an enlarged outer dimension D, so that displacement of the drill bit with the string 12 can result in a pressure differential being created across the drill bit in the wellbore 14. The passage 62 in this example extends downward (as viewed in FIG. 5) to a lower end of the drill bit 16, and extends upward to a location above the enlarged outer dimension D. In this manner, opening of the flow control device 50 can relieve or at least reduce a pressure differential across the enlarged outer dimension D.

In other examples, the flow passage 62 could connect to another flow passage section in another well tool (similar to the arrangement depicted in FIG. 4, wherein the flow passage 62 extends through multiple well tools 38, 40). In this manner, a pressure differential across multiple well tools (including the drill bit 16) due to movement of the string 12 in the wellbore 14 can be reduced or eliminated.

Figure 6:
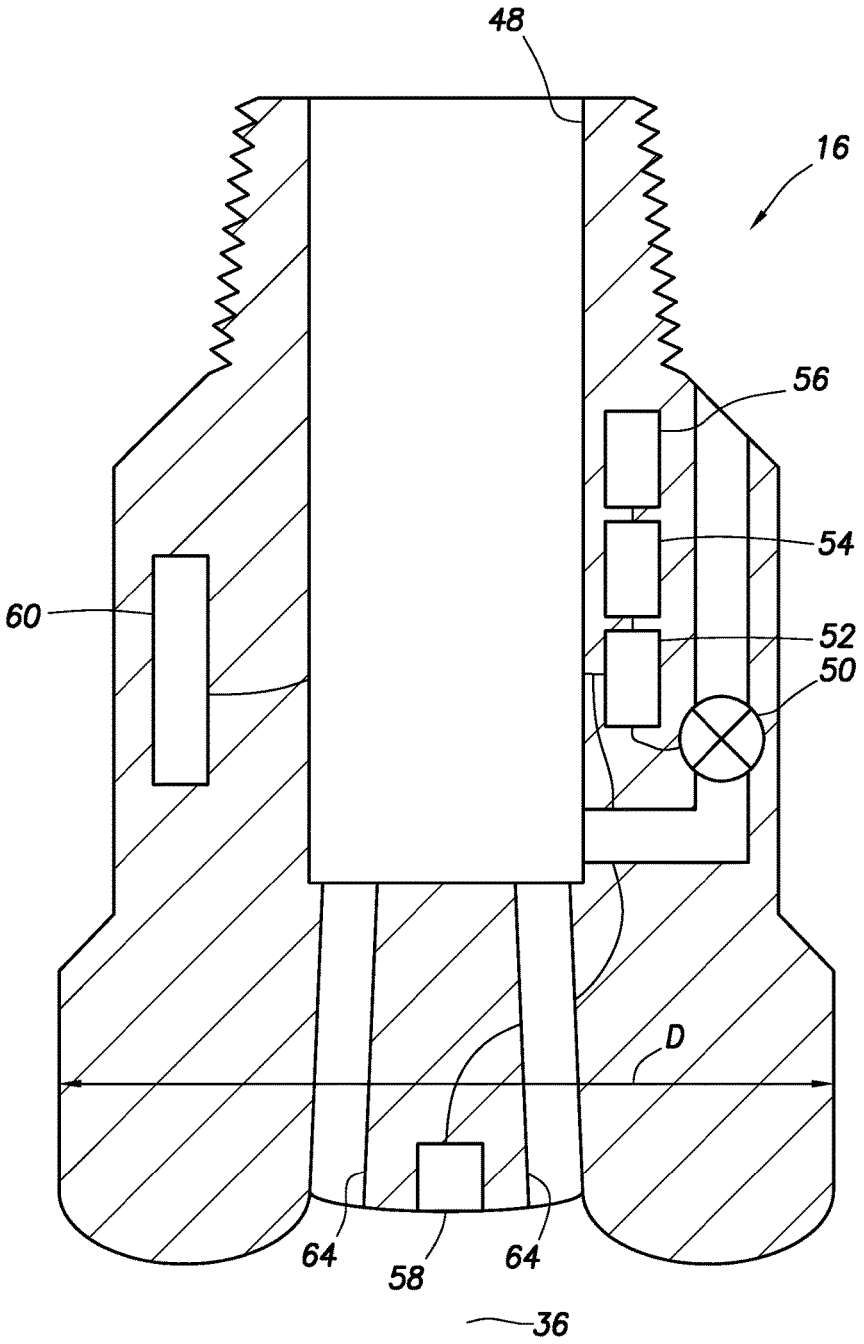
FIG. 6 is a representative cross-sectional view of another example of the drill bit.

FIG. 6 is a representative cross-sectional view of another example of the drill bit 16, in which the separate flow passage 62 (see FIGS. 4 & 5) is not used. Instead, the flow control device 50 is ported to the flow passage 48 which extends through the string 12.

Nozzles 64 which provide for fluid communication between the flow passage 48 and the lower end of the drill bit 16 may be used for reducing or eliminating pressure increases and/or decreases in the bottom of the wellbore 34 below the drill bit. The nozzles 64 may be configured so that a total flow area through the nozzles can be varied during drilling. An example is described in U.S. Publication No. 2003/0010532.

In addition, using the flow passage 48 (which can extend through one or more additional well tools, as in the FIGS. 1-3 examples), opening of the flow control device 50 can be used to relieve or reduce a pressure differential across additional well tools connected above the drill bit 16. That is, the drill bit 16 of FIG. 6 could be incorporated into the well system 10 of FIGS. 1 & 2, and a pressure balancing tool 46 could be connected, for example, above the drill collars 18, in order to reduce or eliminate pressure differentials across the BHA when the string 12 displaces in the wellbore 14. The flow control devices 50 of the drill bit 16 and the pressure balancing tool 46 could open when displacement of the string 12 in the wellbore 14 is sufficient (e.g., as detected by the sensors 58) to create potentially harmful pressure increases and/or decreases in the wellbore.

Figure 7:
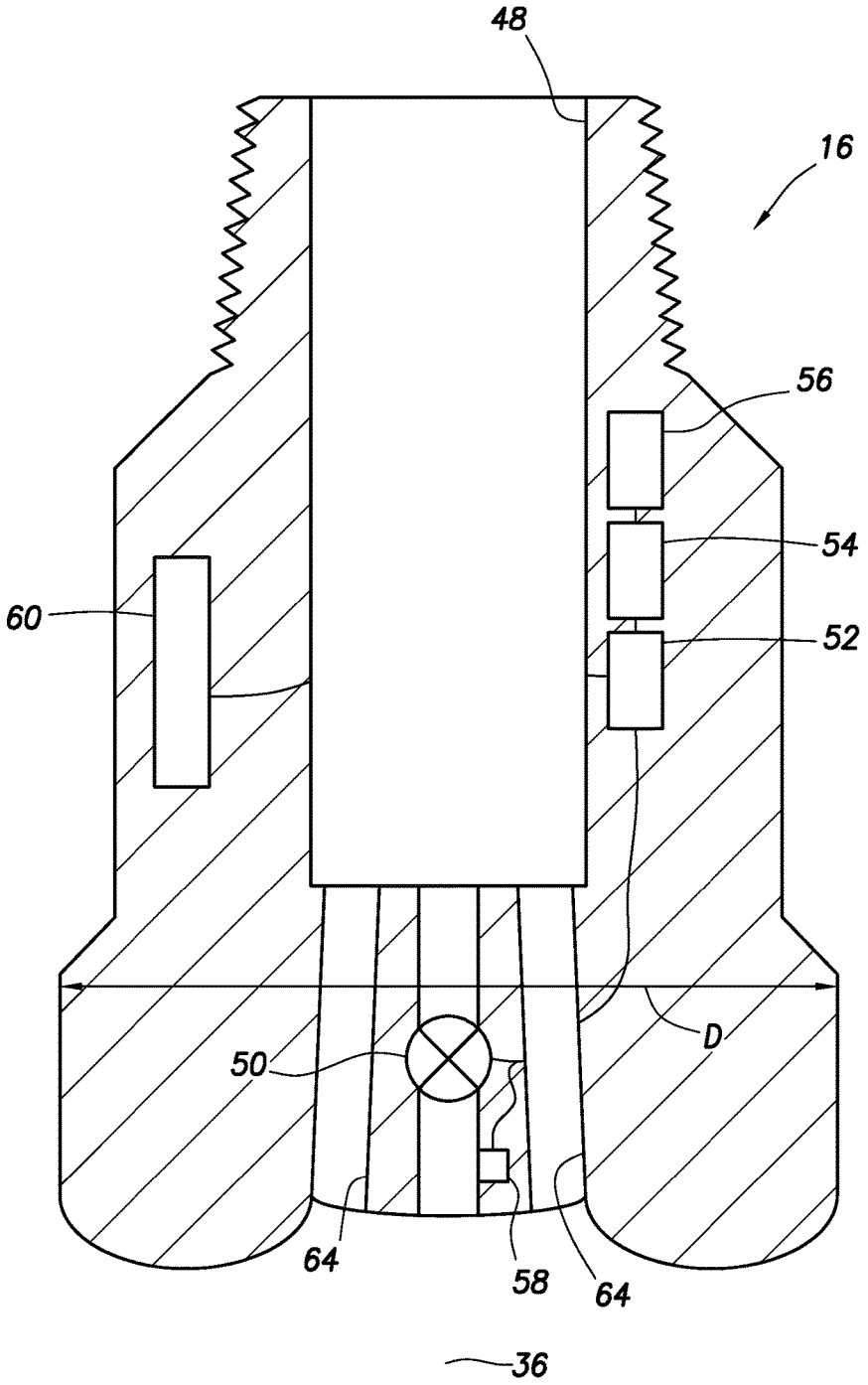
FIG. 7 is a representative cross-sectional view of yet another example of the drill bit.

FIG. 7 is a representative cross-sectional view of yet another example of the drill bit 16. In this example, the flow control device 50 selectively permits and prevents flow directly between the flow passage 48 and the bottom section 36 of the wellbore 14. The drill bit 16 of FIG. 7 could be incorporated into the well system 10 of FIGS. 1 & 2, and a pressure balancing tool 46 could be connected, for example, above the drill collars 18, in order to reduce or eliminate pressure differentials across the BHA when the string 12 displaces in the wellbore 14.

Figure 8:
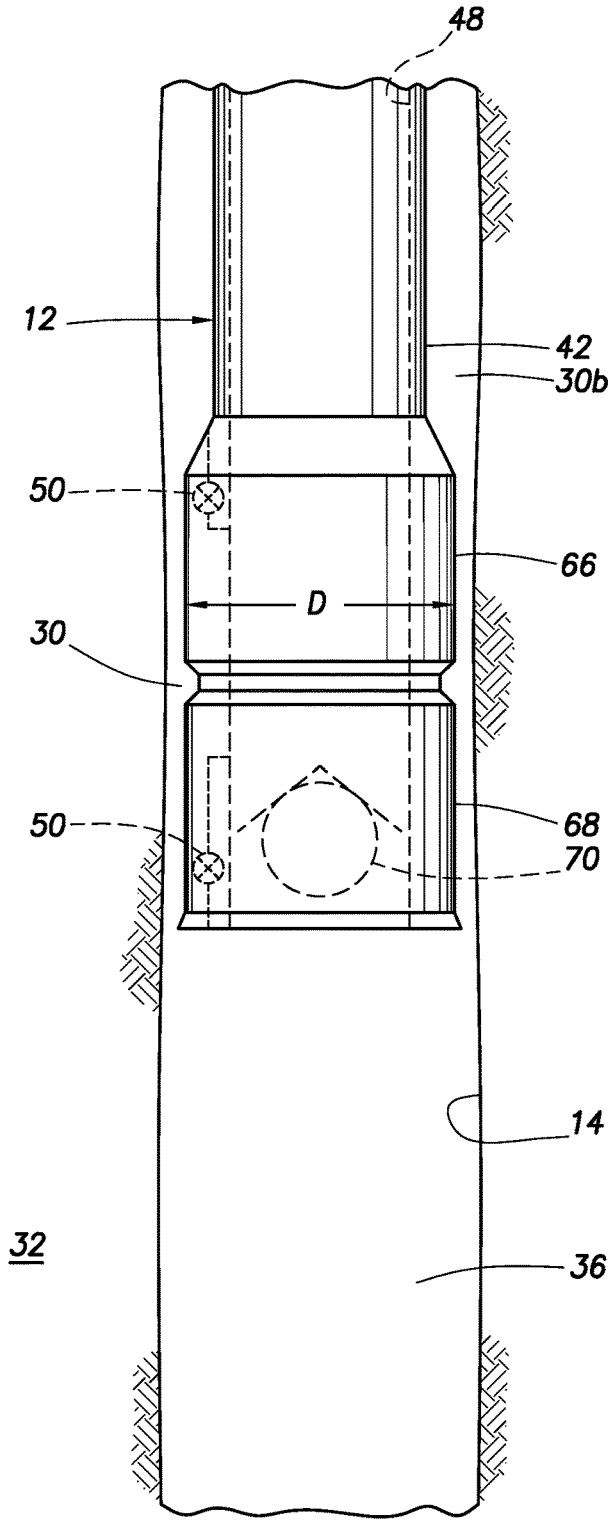
FIG. 8 is a representative partially cross-sectional view of another example of a well system.

Referring additionally now to FIG. 8, another example of the well system 10 and method is representatively illustrated. In this example, the well tool string 12 comprises a casing or liner string which is conveyed into the wellbore 14.

During conveyance of the casing or liner string into the wellbore 14, pressure below the string 12 can increase due, for example, to enlarged outer dimensions D of well tools 66, 68 connected in the string. Pressure in the annulus section 30*b* above the well tools 66, 68 may decrease when the string 12 is conveyed into the wellbore 14, due to a flow restriction in the annulus 30 caused by the enlarged outer dimensions D.

The well tools 66, 68 are depicted in FIG. 8 as comprising a casing shoe (including, e.g., a float shoe and cementing shoe). Flow control devices 50 are incorporated into the well tools 66, 68 in order to reduce or eliminate pressure differentials in the wellbore 14 across the well tools.

The upper flow control device 50 provides selective fluid communication between the flow passage 48 and the upper annulus section 30*b*. The lower flow control device 50 provides selective fluid communication between the flow passage 48 and the wellbore 14 below the string 12, and across a check valve or float valve 70 in the well tool 68.

The flow control devices 50 may be connected to one or more processors 52, sensors 58, power supplies 56 and telemetry devices 60, as described for the other examples above, so that the flow control devices will open when desired to reduce or eliminate pressure differentials across the well tools 66, 68. Although the FIG. 8 example uses the flow passage 48 for relieving the pressure differentials, a separate flow passage 62 could be provided, if desired. Although the flow control devices 50 and associated components are depicted in FIG. 8 as being incorporated into the well tools 66, 68, separate pressure balancing tools 46 could be used instead.

Figure 9:
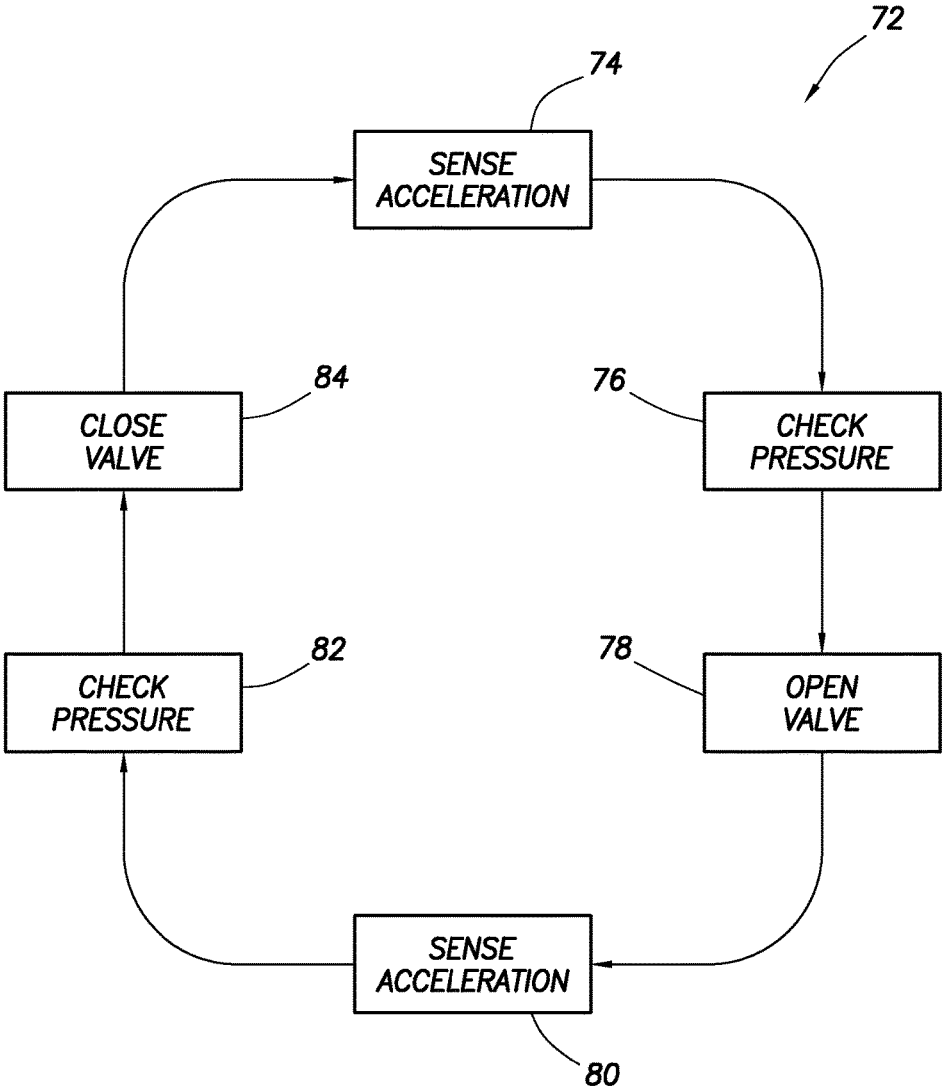
FIG. 9 is a representative flowchart for an example method of mitigating swab and surge effects.

Referring additionally now to FIG. 9, a flowchart for a method 72 of mitigating undesired pressure variations in the wellbore 14 is representatively illustrated. In this example, the sensors 58 comprise both acceleration and pressure sensors, which substantially continuously provide outputs to the processor 52 for determining whether the flow control device 50 should be opened or closed. In other examples, other types of sensors (e.g., a gyroscope or other rotation sensor may be used to determine whether or not the string 12 is rotating).

In step 74, acceleration is sensed by the acceleration sensor 58. In step 76, pressure is sensed by the pressure sensor 58. If the output of either of these sensors 58 indicates that displacement of the string 12 is causing, or will cause, undesired pressure increases and/or decreases in the wellbore 14, the flow control device 50 is opened in step 78. This prevents, relieves or at least reduces pressure differentials across well tools in the string 12.

If a rotation sensor (e.g., a gyroscope in the MWD tool 20) indicates that rotation of the string 12 is less than a predetermined level, and accelerometer and/or pressure sensors indicate an undesired pressure condition is occurring or will be produced, the flow control device 50 can be opened. Weight on bit and/or torque sensors (for example, in the MWD tool 20) could be used to ensure that the string 12 is not being used to drill the wellbore 14 when the flow control device 50 is opened.

That is, it is preferred that the flow control device 50 not be opened if the string 12 is being used to drill the wellbore 14. Various types of sensors (e.g., a gyroscope or other rotation sensor, a weight on bit sensor, a torque sensor), in combination with appropriate logic programming, may be used to determine whether drilling is currently being performed.

If a downhole electrical generator is included in the string 12 to generate electrical power in response to flow of the drilling fluid 28 through the string, an output of the generator may provide an indication of whether a drilling ahead operation is occurring. For example, if a revolutions per minute, voltage output or current output of the generator indicates that the fluid 28 is circulating through the string 12, this can be an indication that a drilling ahead operation is occurring (although, in some situations, fluid may be circulated through the string while not drilling ahead).

In steps 80 and 82, acceleration and pressure are again sensed by the sensors 58. If the outputs of the sensors 58 do not indicate that displacement of the string 12 is causing, or will cause, undesired pressure increases and/or decreases in the wellbore 14, the flow control device 50 is closed in step 84. This allows normal operations (e.g., drilling operations, stimulation or completion operations or cementing operations) to proceed without the flow control device 50 being open.

The flow control device 50 can be prevented from opening if the sensors 58 detect compression or torque in the string 12, or rotation of the string, as described above. This can be particularly advantageous if the flow control device 50, passage 48 and/or other components are located in the drill bit 16, so that these components are not plugged or otherwise damaged by drill cuttings.

Although FIG. 9 depicts certain steps 74, 76, 78, 80, 82, 84 as being performed in a certain order, this order of steps is not necessary in keeping with the scope of this disclosure. Instead, the FIG. 9 flowchart is intended to convey the concept that the outputs of the sensors 58 are substantially continuously (or at least regularly or periodically) received by the processor 52 for a determination of whether the flow control device 50 should be opened or closed.

Note that, if a choke is used for the flow control device 50, then opening or closing the flow control device can include partially opening or partially closing the flow control device. Thus, fluid communication between wellbore sections may be increased or decreased via the flow control device 50, without such fluid communication through the flow control device being completely permitted or prevented.

It may now be fully appreciated that the above disclosure provides significant advancements to the art of mitigating swab and surge effects in wellbores. In examples described above, undesired pressure increases and decreases in the wellbore 14 can be mitigated by use of one or more flow control devices 50 that reduce or prevent pressure differentials across well tools caused by displacement of a well tool string 12 in the wellbore.

A method 72 of mitigating undesired pressure variations in a wellbore 14 due to movement of a well tool string 12 is provided to the art by the above disclosure. In one example, the method 72 can comprise: selectively decreasing and increasing fluid communication between sections (e.g., bottom section 36, annulus sections 30*a,b*) of a wellbore 14 on opposite sides of at least one well tool 16, 18, 20, 22, 24, 26, 38, 40, 66, 68 in the well tool string 12, the fluid communication being increased in response to detecting a threshold movement of the well tool string 12 relative to the wellbore 14.

The threshold movement may comprise a predetermined level of acceleration of the well tool string 12. The well tool string 12 can include at least one sensor 58 which senses acceleration of the well tool string 12.

The threshold movement may comprise sufficient movement of the well tool string 12 to cause a predetermined level of pressure differential across the well tool 16, 18, 20, 22, 24, 26, 38, 40, 66, 68. The well tool string 12 can include at least one sensor 58 which senses a pressure differential across the well tool 16, 18, 20, 22, 24, 26, 38, 40, 66, 68. The pressure differential may be in an annulus 30 external to the well tool string 12.

The fluid communication may be prevented in response to detecting compression and/or torque in the well tool string 12.

The step of providing the fluid communication can comprise opening at least one flow control device 50, thereby providing fluid communication between an internal flow passage 48, 62 of the well tool string 12 and each of the wellbore sections 36, 30*a,b*. The flow passage 48 may be configured for directing drilling fluid 28 to a drill bit 16. The flow passage 48 may extend through a drill bit 16.

A well tool string 12 is also provided to the art by the above disclosure. In one example, the string 12 can include at least one well tool 16, 18, 20, 22, 24, 26, 38, 40, 66, 68 connected in the well tool string 12, the well tool 16, 18, 20, 22, 24, 26, 38, 40, 66, 68 having an outer dimension D which is enlarged relative to at least one adjacent section 42, 44 of the well tool string 12, a flow passage 48, 62 extending between opposite ends of the well tool 16, 18, 20, 22, 24, 26, 38, 40, 66, 68, a sensor 58, and at least one flow control device 50 configured to selectively increase and decrease fluid communication between the opposite ends of the well tool 16, 18, 20, 22, 24, 26, 38, 40, 66, 68 via the flow passage 48, 62, in response to an output of the sensor 58 indicative of movement of the well tool string 12.

The well tool string 12 can comprise multiple flow control devices 50, actuation of the flow control devices 50 being synchronized, so that the flow control devices 50 open and close together. The actuation of the flow control devices 50 may be synchronized via telemetry.

Preferably, the flow control devices 50 provide indications of their positions/configurations (e.g., open or closed). Such indications may be transmitted to a remote location (such as, to a control system at the earth's surface). Based on these indications, additional control could be exercised over the various tools in the string 12.

Flow through the flow passage 48, 62 may be permitted in response to the sensor 58 output being indicative of a predetermined level of acceleration of the well tool string 12, and/or in response to the sensor 58 output being indicative of a predetermined level of pressure differential across the well tool 16, 18, 20, 22, 24, 26, 38, 40, 66, 68.

Flow through the passage 48, 62 may not be permitted in response to the sensor 58 output being indicative of a drilling ahead operation. For example, if the string 12 is rotating at greater than a predetermined level of revolutions per minute (e.g., as measured by a rotation sensor), if there is compression in the string (e.g., as measured by a weight on bit sensor), and/or if there is torque in the string (e.g., as measured by a torque sensor), then the flow control device(s) 50 may not be opened.

Another method 72 of mitigating undesired pressure differentials across at least one well tool 16, 18, 20, 22, 24, 26, 38, 40, 66, 68 in a well tool string 12 is also described above. In one example, the method 72 comprises sensing at least one parameter indicative of pressure differential across the well tool 16, 18, 20, 22, 24, 26, 38, 40, 66, 68; and opening at least one flow control device 50, thereby providing fluid communication between sections 36, 30*a,b* of a wellbore 14 on opposite sides of the well tool 16, 18, 20, 22, 24, 26, 38, 40, 66, 68, the opening being performed when the parameter exceeds a threshold level.

The parameter may comprise acceleration of the well tool string 12. The parameter may comprise pressure differential between the wellbore sections 36, 30*a,b*. Other measured parameters may include rotation, weight on bit 16 and torque in the string 12.

The opening step can include permitting flow through a flow passage 48, 62 extending through the well tool 16, 18, 20, 22, 24, 26, 38, 40, 66, 68.

The flow passage 48 may be configured for directing drilling fluid 28 to a drill bit 16. The flow passage 48, 62 may extend through the drill bit 16. The flow passage 48, 62 may extend longitudinally through the well tool string 12.

The opening step may comprise opening multiple flow control devices 50, thereby permitting fluid communication between the flow passage 48, 62 and the wellbore sections 36, 30*a,b*.

The method 72 can include synchronizing the opening and/or closing of the flow control devices 50 via telemetry. Such wired or wireless telemetry may be initiated from the surface, and/or from downhole control systems.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal or vertical, and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," and "lower") are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus or device is described as "including" a certain feature or element, the system, method, apparatus or device can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of mitigating pressure variations in a wellbore due to movement of a well tool string, the method comprising:

moving the well tool string in the wellbore; and selectively decreasing or increasing fluid communication between a first section of an annulus external to and above at least one well tool in the well tool string and a second section external to and below the at least one well tool, the fluid communication being decreased or increased in response to detecting a threshold movement of the well tool string relative to the wellbore.

2. The method of claim 1, wherein the threshold movement comprises a predetermined level of acceleration of the well tool string.

3. The method of claim 1, wherein the well tool string includes at least one sensor which senses acceleration of the well tool string.

4. The method of claim 1, wherein the threshold movement comprises sufficient movement of the well tool string to cause a predetermined level of pressure differential across the well tool.

5. The method of claim 1, wherein the well tool string includes at least one sensor which senses a pressure differential across the well tool.

6. The method of claim 5, wherein the pressure differential is in the annulus external to the well tool string.

7. The method of claim 1, wherein the fluid communication is decreased in response to detecting at least one of compression, torque and rotation in the well tool string.

8. The method of claim 1, wherein providing the fluid communication comprises opening at least one flow control device, thereby providing fluid communication between an internal flow passage of the well tool string and each of the wellbore sections.

9. The method of claim 8, wherein the flow passage is configured for directing drilling fluid to a drill bit.

10. The method of claim 8, wherein the flow passage extends through a drill bit.

* * * * *